US005746129A

United States Patent [19]

Murray

[11] Patent Number: 5,746,129

[45] Date of Patent: May 5, 1998

[54] COMPLIANT DOCTORING CUP

[75] Inventor: Michael P. Murray, Keene, N.H.

[73] Assignee: Markem Corporation, Keene, N.H.

[21] Appl. No.: 721,679

[22] Filed: Sep. 27, 1996

[51] Int. Cl.[6] ..... B41M 1/10

[52] U.S. Cl. ..... 101/483; 101/169; 101/163

[58] Field of Search ..... 101/163, 167, 101/169, 170, 41, 483

[56] References Cited

U.S. PATENT DOCUMENTS

| | | | |
|---|---|---|---|
| 4,393,775 | 7/1983 | Cappel et al. | 101/167 |
| 4,432,282 | 2/1984 | Jurinak | 101/169 |
| 4,557,195 | 12/1985 | Phlipp | 101/167 |
| 4,905,594 | 3/1990 | Phillip et al. | 101/167 |
| 5,003,872 | 4/1991 | Dalferth | 101/163 |
| 5,272,972 | 12/1993 | Tobita | 101/163 |
| 5,320,037 | 6/1994 | Harris | 101/163 |
| 5,392,706 | 2/1995 | Drew, II et al. | 101/170 |
| 5,476,040 | 12/1995 | Kleist | 101/167 |
| 5,577,442 | 11/1996 | Tanaka et al. | 101/169 |

FOREIGN PATENT DOCUMENTS

| | | | |
|---|---|---|---|
| 2011228 | 10/1971 | Germany | 101/169 |
| 2205430 | 6/1981 | Germany | 101/163 |

*Primary Examiner*—Edgar S. Burr
*Assistant Examiner*—Amanda B. Sandusky
*Attorney, Agent, or Firm*—Fish & Richardson P.C.

[57] ABSTRACT

A compliant doctoring cup particularly suited for inking non-flat plates includes a body defining a cavity for containing ink and a blade with two free ends coupled to the body along a periphery of the cavity. The body of the cup defines a channel generally along a periphery of the cavity and the blade is positioned within the channel. A resilient member, for example, a liner, interfaces the blade to the body of the cup. The liner contains the ink and defines the channel.

13 Claims, 5 Drawing Sheets

COMPLIANT DOCTORING CUP

BACKGROUND OF THE INVENTION

The invention relates to ink cups for doctoring gravure printing plates.

Doctoring ink cups are generally very rigid to ensure long wear life. Gravure printing plates used with the cups are generally made of hardened steel and are required to be extremely flat (within 0.0002 inches/inch) in order to provide a good ink seal with the equally flat doctoring ink cup edge. Due to high costs associated with the combination of hard flat doctoring ink cups and hard flat plates, soft, flexible, non-flat plates are being used.

Soft, non-flat plates when used with hard doctoring ink cups may be easily damaged resulting in poor doctoring quality. Increasing the pressure on the cup, while resulting in a marginal improvement in doctoring quality, may further damage the plate.

SUMMARY OF THE INVENTION

The compliant doctoring cup of the invention addresses these problems by providing a compliant doctoring edge that can move, particularly along a vertical direction, in response to non-uniformities in the plate's surface.

A compliant doctoring cup particularly suited for inking non-flat plates includes a body defining a cavity for containing ink and a blade with two free ends coupled to the body along a periphery of the cavity.

Preferred embodiments have a resilient member interfacing the blade to the body of the cup. The body of the cup defines a channel generally along a periphery of the cavity and the blade is positioned within the channel. The channel includes a first section for clamping the blade and a second section spaced from the blade. The ends of the blade overlap. A liner located within the cavity contains the ink and defines the channel. The liner is held between the body and an outer member. The body of the cup comprises two joinable sections.

According to another aspect of the invention, a pad printing machine includes a pad for transferring ink from a printing plate to the object to be printed and a compliant doctoring cup for removing some of the ink from the plate.

According to another aspect of the invention, a method of inking a printing plate includes providing a compliant doctoring cup, positioning the printing plate below the cup cavity with the blade in contact with the plate to cover the plate with ink, and removing some of the ink from the plate with the blade.

Advantages of the compliant doctoring cup of the invention can include high-quality doctoring of non-flat plates, and doctoring at lower pressures than with conventional rigid doctoring cups for both flat and non-flat plates. The lower doctoring pressures associated with the soft cup prolong the life of the plate. Further advantages can include disposability of the liner and-blade, reduced clean-up time, and less expensive gravure plates.

Other features and advantages will be apparent from the following description and from the claims.

DESCRIPTION OF THE PREFERRED EMBODIMENT

Figure 1:
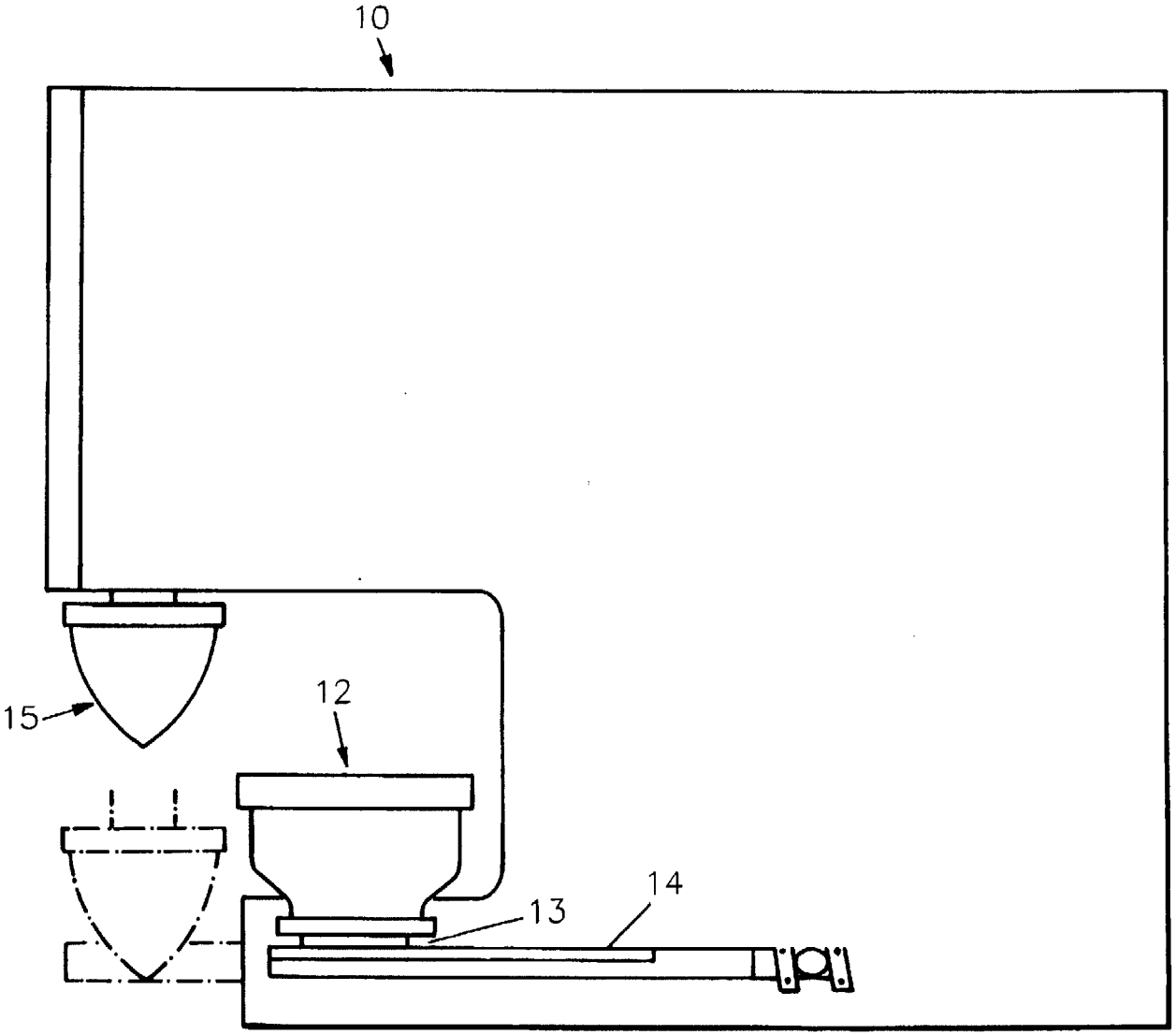
FIG. 1 is a schematic of a pad printing machine.

Referring to FIG. 1, a pad printing machine 10 includes a stationary doctoring cup 12 positioned over a movable printing plate 14 engraved with a pattern to be printed. Doctoring cup 12 includes a plate contacting edge 13. To pick-up ink from plate 14 for transferring to an object to be printed (not shown), plate 14 moves from below cup 12 and a pad 15 is lowered onto the plate. Movement of plate 14 relative to a plate contacting edge 13 removes excess ink from plate 14 so that contact of pad 15 with plate 14 transfers only the desired image to the pad.

Figure 2:
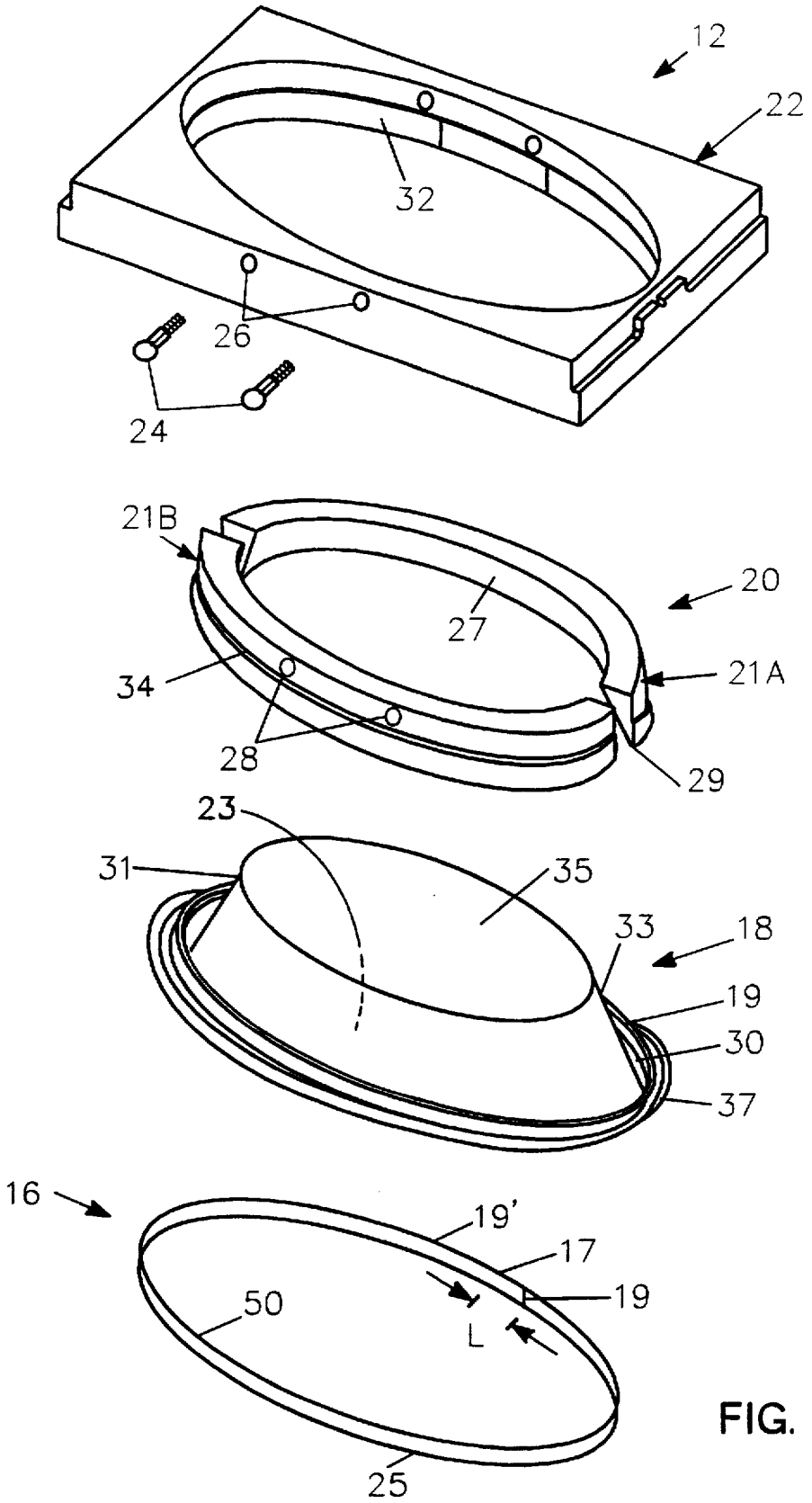
FIG. 2 is an exploded view of a doctoring cup of the pad printing machine of FIG. 1.
Figure 3:
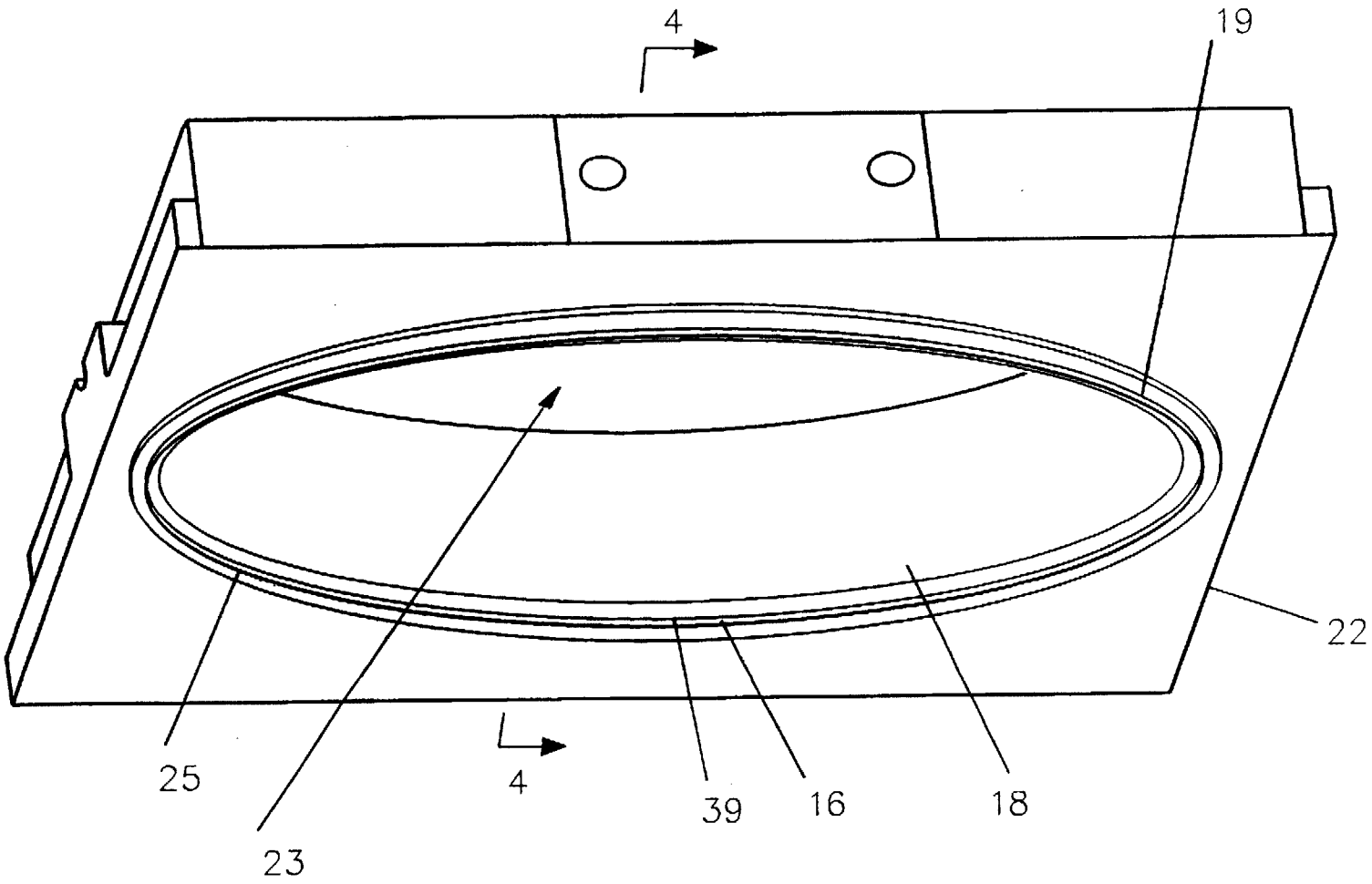
FIG. 3 is an isometric view of the doctoring cup of FIG. 2 shown from below.

Referring to FIGS. 2 and 3, cup 12 of the invention includes a doctor blade 16, a liner 18, an inner core 20, and an outer ring 22. Blade 16 is a thin, flat piece of a suitable material, for example, spring steel, having a thickness in the range of about 0.01 to 0.025 inch, preferably about 0.020 inch, a width in the range of about 0.25 to 0.5 inch, preferably about 0.375 inch, and a length dependant upon the size of ink reservoir 23, for example, to imprint an area of about 4 inches by 8 inches, the blade length is in the range of about 24 to 28 inches, preferably about 26.25". A bottom edge 25 of blade 16 forms the plate contacting edge 13 of cup 12. Plate contacting edge 13 is lapped flat to a flatness of about 0.0001 to 0.0002 inch. Blade 16 can be processed in bulk coil form by a standard lapping machine. Blade 16 is bent into a desired shape, for example, elliptical, and includes a section of overlap 17 of length L, for example, about 2 to 2.5 inches. Ends 19, 19' of blade 16 are free to move relative to each other, i.e., the blade is not welded at the ends and does not include any adhesive or fastening means to remain in the desired shape.

Liner 18 defines ink reservoir 23, where the ink is contained while the machine is in use. Liner 18 is formed, for example, by vacuum forming from a plastic such as high density polyethylene to impart chemical resistance to the liner. Angled wall 31 and surface 35 of liner 18 define ink reservoir 23. Blade 16 is positioned within a channel 19 in liner 18 along a periphery 39 of ink reservoir 23. Channel 19 is wider along a section 33 corresponding to the length L of blade overlap 17 to accommodate the increased thickness of overlap 17. In addition to holding blade 16, the combination of a flexible liner 18 and a blade having free ends 19, 19' allows blade 16 to float in a vertical direction and provide high doctoring quality when used with a non-flat plate, for example, plates out of flat by more than 0.0002 inches/inch, by movement of the blade accommodating for any irregularities in the plate. The liner also facilitates cleaning of doctoring cup 12 since it can be removed and cleaned or replaced.

Figure 4:
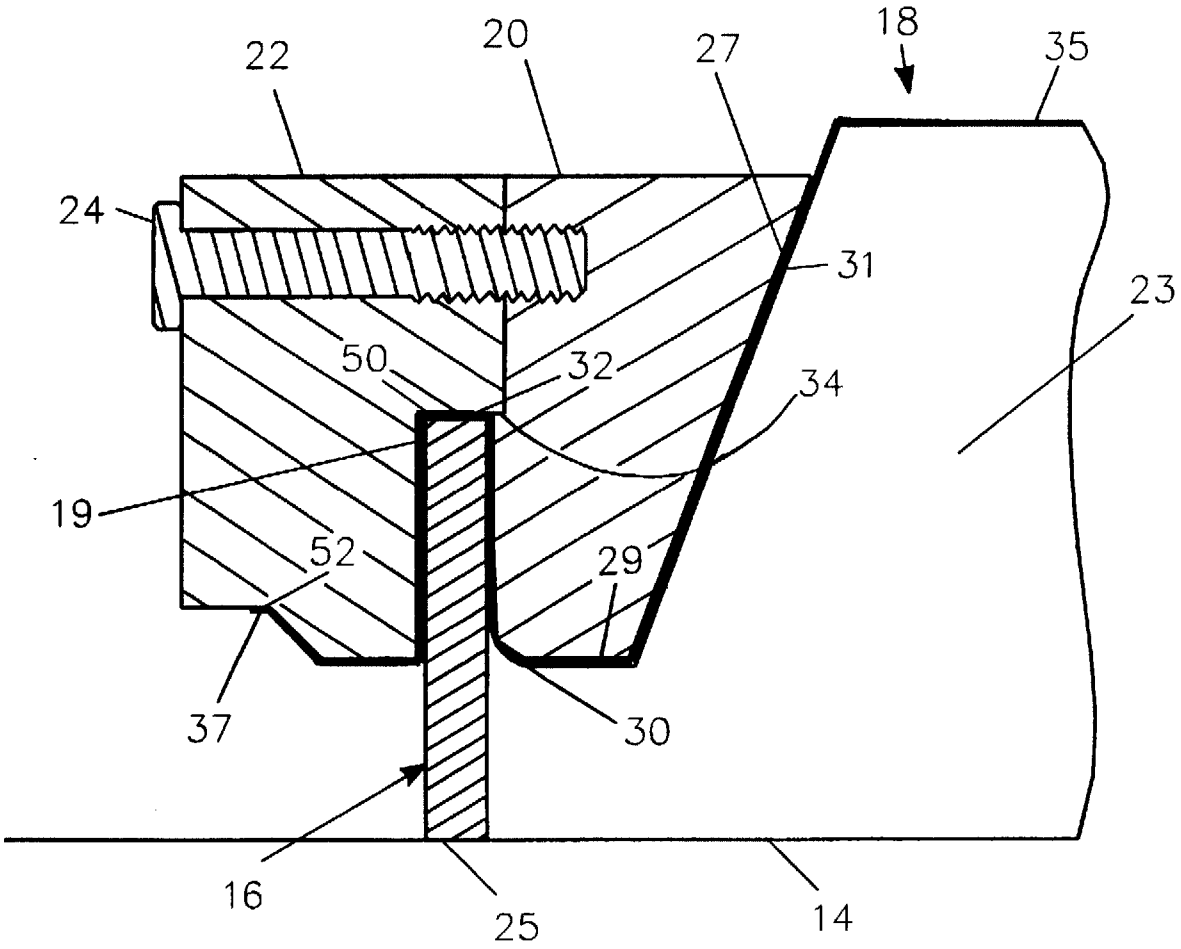
FIG. 4 is a cross-sectional view of the doctoring cup of FIG. 3, taken along line 4—4.

Inner core 20 includes two sections, 21A and 21B, which can be formed, for example, from aluminum. Outer ring 22 can be formed, for example, from steel or aluminum. Referring also to FIG. 4, inner core sections 21A and 21B have sloped inner portions 27 corresponding to angled wall 31 of liner 18. Inner core sections 21A and 21B define a bottom edge 29 which contacts a lower edge 30 of liner 18.

Inner core 20 is mounted to outer ring 22 by bolts 24 which pass through holes 26 in outer ring 22 and are secured within threaded bores 28 in inner core 20. A top edge 50 of blade 16 and an edge 34 defined by core 20 abut a notch 32 in outer ring 22. As shown in FIG. 4, when assembled, liner channel 19 is positioned within notch 32 between inner core 20 and outer ring 22. An outer lip 37 of liner 18 conforms to a surface 52 of outer ring 22.

In use, ink reservoir 23 of cup 12 is filled with ink and placed in contact with plate 14, as shown in FIG. 1. As the engraved portion of plate 14 slides out from under cup 12, excess ink not in the engraving is scraped off the plate by doctor blade 16. Because blade 16 is not rigidly attached to cup 12, blade 16 can follow the surface of the plate and adjust for any slight irregularities in the plate's surface. Thus, high quality doctoring can be accomplished using non-flat plates without the need for applying high pressures to doctoring edge 13. Blade 16 therefore wears more slowly than at high pressures and less expensive plates can be used.

Figure 5:
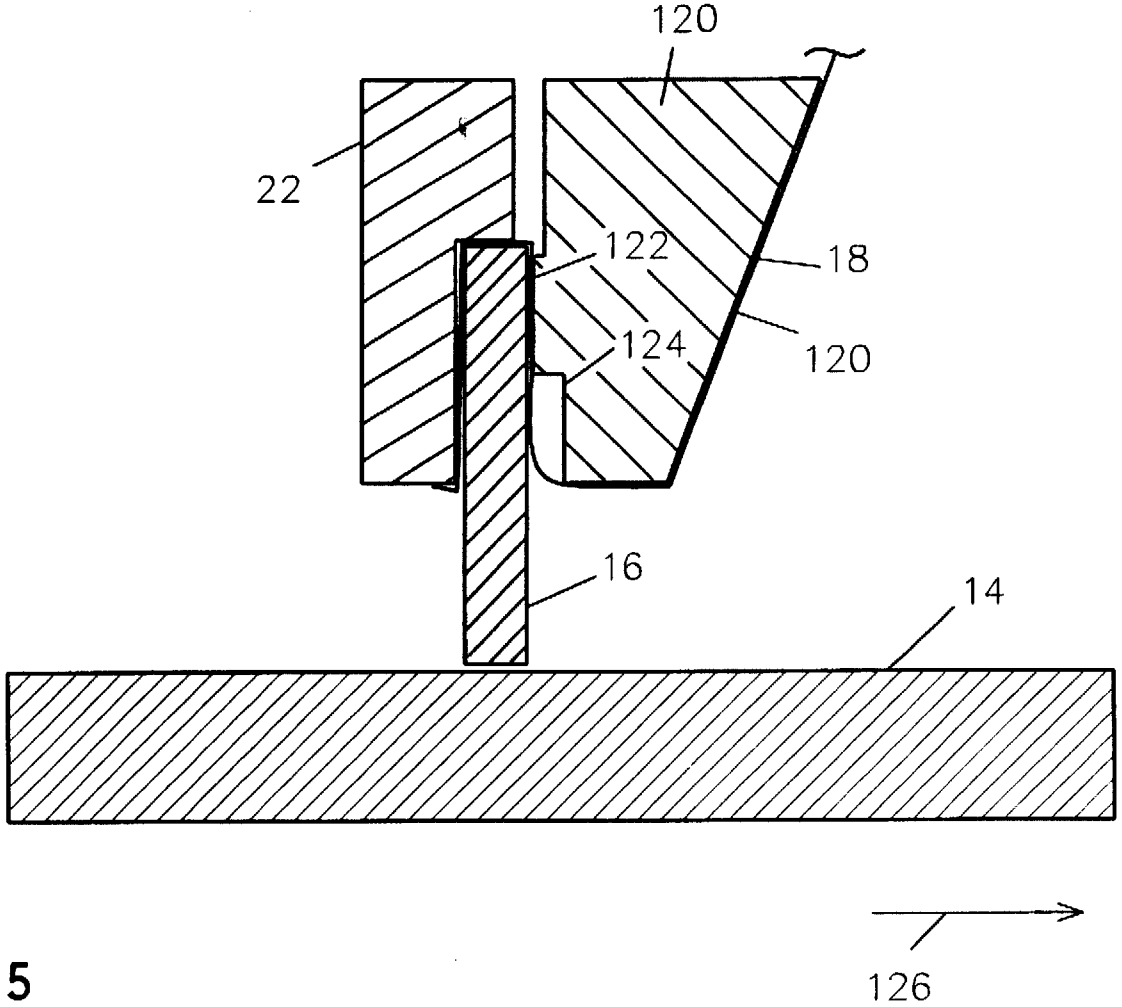
FIG. 5 is a cross-sectional view of the doctoring cup, similar to that of FIG. 4, showing an alternative embodiment of the inner core.

Referring to FIG. 5, in an alternative, preferred embodiment, inner core 120 includes a first section 122 for clamping blade 16 within liner 18 between inner core 120 and outer core 22, and a second section 124 spaced from blade 16 by a distance about the same as the blade thickness. This configuration of inner core 120 allows blade 16 to flex slightly as plate 14 travels in the direction of arrow 126 during the plate's return to its position under cup 12 after pad transfer. This further reduces wear on blade doctoring edge 13.

Other embodiments are within the scope of the following claims.

What is claimed is:

1. A method of inking a printing plate, comprising providing a compliant doctoring cup comprising a body defining a cavity, said cavity containing ink, and a curved blade having a doctoring edge and two free ends coupled to said body along a periphery of said cavity, positioning the printing plate below said cavity with the doctoring edge of said blade in contact with the printing plate to cover the printing plate with said ink, and removing some of said ink from the printing plate with said blade.

2. A compliant doctoring cup comprising: a body defining a cavity for containing ink, and a blade having a doctoring edge and two free ends, said blade being coupled to said body along a periphery of said cavity.

3. The compliant doctoring cup of claim 2 wherein said body includes a resilient member.

4. The compliant doctoring cup of claim 2 wherein said body further defines a channel generally along a periphery of said cavity, said blade being positioned within said channel.

5. The compliant doctoring cup of claim 4 wherein said channel includes a first section for clamping said blade and a second section spaced from said blade.

6. The compliant doctoring cup of claim 2 wherein said ends of said blade overlap.

7. The compliant doctoring cup of claim 2 further comprising a liner positioned within said cavity for containing ink.

8. The compliant doctoring cup of claim 7 wherein said liner defines a channel generally along a periphery of said cavity, said blade being positioned within said channel.

9. The compliant doctoring cup of claim 7 wherein said body further includes an inner member and an outer member, said liner being held between said inner member and said outer member.

10. The compliant doctoring cup of claim 9 wherein said inner member comprises two sections joinable by attachment to said outer member.

11. A pad printing machine comprising:

a pad for transferring ink from a printing plate to an object to be printed, and a compliant doctoring cup for removing some of the ink from the printing plate, said compliant doctoring cup including a body defining a cavity for containing ink, and a curved blade having a doctoring edge and two free ends, said blade being coupled to said body along a periphery of said cavity.

12. A compliant doctoring cup comprising:

an outer member defining an opening, an inner member located within said opening and attached to said outer member such that a circumferential groove is defined between said inner member and said outer member, said inner member defining a second opening, a liner defining a cavity for containing ink, said cavity being located in said second opening, said liner further defining a channel, said channel being located in said circumferential grove, and a curved blade having a doctoring edge and two free ends, said blade being located within said channel.

13. The compliant doctoring cup of claim 12 wherein said inner member includes first and second sections.

* * * * *